US006138363A

United States Patent [19]

Kawashima

[11] Patent Number: 6,138,363

[45] Date of Patent: Oct. 31, 2000

[54] PORTABLE KNIFE

[76] Inventor: Haruo Kawashima, c/o Tabata Co., Ltd., 1-3-17 Higashi-Komagata, Sumida-ku, Tokyo, Japan

[21] Appl. No.: 09/156,499

[22] Filed: Sep. 18, 1998

[30] Foreign Application Priority Data

Sep. 19, 1997 [JP] Japan ..... 9-255789

[51] Int. Cl.[7] ..... B26B 29/02

[52] U.S. Cl. ..... 30/151; 30/162; 224/232

[58] Field of Search ..... 30/151, 162, 286, 30/295; 224/232

[56] References Cited

U.S. PATENT DOCUMENTS

| | | | |
|---|---|---|---|
| 2,618,057 | 11/1952 | Gibson | 30/151 |
| 4,523,379 | 6/1985 | Osterhout et al. | 30/151 |
| 5,123,167 | 6/1992 | Kelley | 30/151 |
| 5,255,436 | 10/1993 | Yoshida | 30/151 |
| 5,315,761 | 5/1994 | Norton et al. | 30/162 |
| 5,511,311 | 4/1996 | Collins | 30/162 |
| 5,794,347 | 8/1998 | Serpa | 30/162 |

FOREIGN PATENT DOCUMENTS

| | | |
|---|---|---|
| 55-13759 | 4/1980 | Japan . |
| 2-268793 | 11/1990 | Japan . |

*Primary Examiner*—Rinaldi I. Rada
*Assistant Examiner*—Kim Ngoc Tran
*Attorney, Agent, or Firm*—Lowe Hauptman Gopstein Gilman & Berner

[57] ABSTRACT

A portable knife includes a retainer portion to reliably hold a knife within a sheath even when a grip of the knife collides with a solid object. An actuating slider mounted in proximity to the retainer portion slides in the direction along which the knife is drawn out from the sheath. A bottom portion of the actuating slider slidable along one of slide surfaces of locking projections formed on the knife grip pushes up the retainer portion engaged with the locking projections until the retainer portion is disengaged from the locking projection.

4 Claims, 2 Drawing Sheets

PORTABLE KNIFE

BACKGROUND OF THE INVENTION

This invention relates to a portable knife and more particularly to a diver's portable knife.

Japanese Patent Application Publication No. Sho55-13759 discloses a knife holder having a stopper adapted to retain a guard from its upper surface. A knob of the knife may be pulled by a diver to remove the stopper's effect and thereby to draw the knife from a sheath. To facilitate the knob to be pulled by the diver, the knob normally projects laterally from the guard.

Japanese Patent Application Laid-Open No. Hei2-268793 discloses a knife holder provided in the vicinity of an open end of a sheath through which a knife is inserted into and drawn from the sheath with a pair of L-shaped elastic arms which are engageable with a lower surface of a guard of the knife. Depressions on ends of these arms causes the arms to be elastically deformed and thereby to be disengaged from the lower surface of the guard, allowing the knife to be drawn from the sheath.

The knob laterally projecting from the sheath in the knife holder described in the Japanese Patent Application Publication No. Sho55-13759 may obstruct movement of the diver, though it is not so serious to put the diver in danger. However, it is desirable for a diver's outfit to have minimal such projections.

With the knife holder disclosed in the Japanese Patent Application Laid-Open No. Hei2-268793, the diver must requested operate the pair of arms with his or her two fingers. In such a case, the arms must be quickly held with two fingers to draw the knife without being delayed. Sometimes it takes too much time to draw out the knife.

Furthermore, both the stopper and the arms are of one-touch operated type. This means that the knife may be often unintentionally fall off from the sheath when the grip collides with or is caught by a solid object.

SUMMARY OF THE INVENTION

In view of the problems as described above, it is a principal object of the invention to provide a portable knife having a stopper improved so as to eliminate undesirable projections and enable the stopper means to operate quickly and to reliably hold the knife within a sheath even when a grip of the knife collides with a solid object.

The object set forth above is achieved, according to the invention, by a portable knife comprising a knife having a blade and a grip connected to the blade. The grip is provided with a locking projection on at least one side of the grip and the locking projection has a slide surface sloped upwardly, assuming that the one side of the blade having the locking projection is turned upward, from the blade toward the grip.

A sheath includes a first sidewall, a second sidewall, an open end and a stopper. The first and second sidewalls are connected along their peripheries to define the open end and provide space for the blade to be inserted therebetween. The stopper means comprises an elastically deformable retainer portion and an actuating slider. The retainer portion is defined by a pair of slits provided in at least one sidewall of the sheath so as to extend from the open end toward a distal end opposite the open end and to be spaced from each other transversely of the sidewall and having inner and outer surfaces and an annular frame projecting from the open end, which annular frame is slidable on the sloped slide surface of the locking projection of the knife and engageable with of the locking projection when the blade of the knife is inserted into the sheath. The actuating slider has a top portion for a user of the knife to put his or her finger on, a bottom portion which is adjacent the inner surface of the retainer portion and slidable on the sloped slide surface of the locking projection, and side portions movable in the pair of slots of the side wall. The bottom portion pushes up the retainer portion when the bottom portion slides upward along the sloped slide surface of the locking projection.

DESCRIPTION OF THE PREFERRED EMBODIMENT

Details of the portable knife according to the invention will be more fully and specifically understood from the following description of a preferred embodiment accompanied by FIGS. 1–5.

Figure 1:
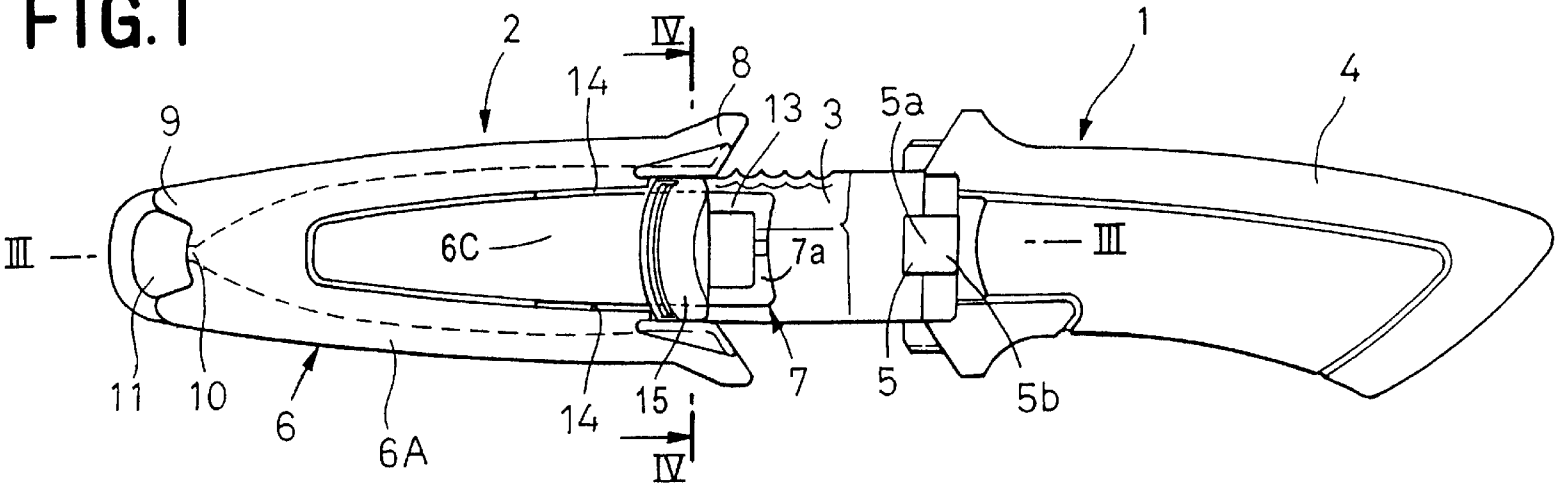
FIG. 1 is a front view of a portable knife of the invention with a blade of the portable knife partially inserted into a sheath of the knife.

FIG. 1 is a front view showing a knife holder 2 as a blade 3 of a knife 1 partially inserted into (or drawn from) the knife holder 2.

Figure 2:
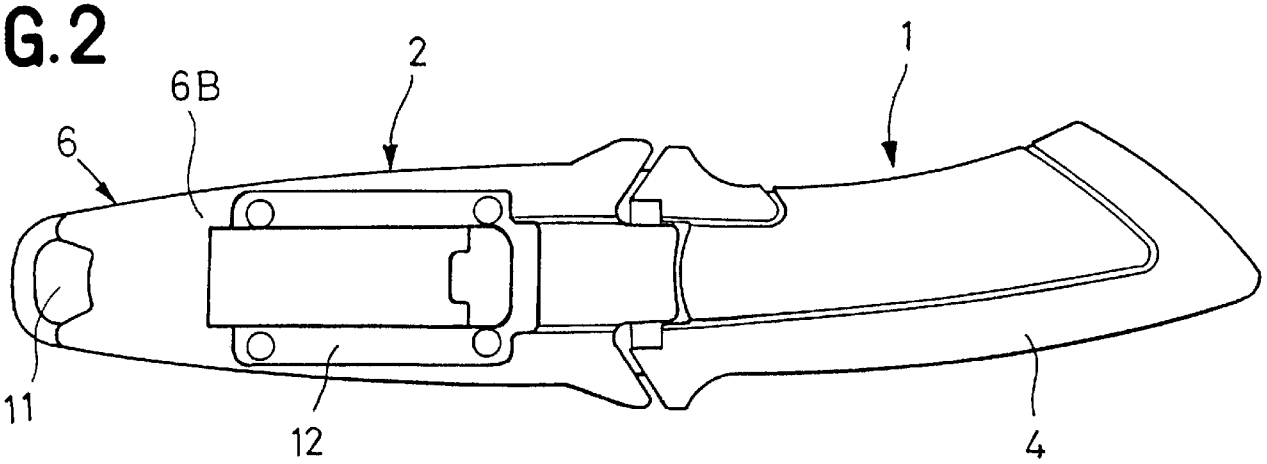
FIG. 2 is a rear view of the portable knife with the blade completely inserted into the sheath.

FIG. 2 is a rear view showing the knife holder 2 with the blade 3 completely inserted into the knife holder 2.

As shown in FIGS. 1 and 2, the portable knife 1 includes the metallic blade 3 and a plastic grip 4. The grip 4 is respectively provided on its opposite surfaces at an end thereof adjacent the blade 3 with locking projections 5 which are adapted to be interlocked with the knife holder 2 upon complete insertion of the blade 3 into the knife holder 2 and thereby prevent unintentional removal of the knife 1 the knife holder.

The knife holder 2 has a sheath 6 adapted to receive the blade 3 and a retainer portion 7 formed integrally with the sheath. The sheath 6 has a first side wall 6A and a second side wall 6B which are connected with each other along side edges thereof to define a proximal open end 8 and a space into which blade 3 is inserted, and a distal end 9 opposed to the proximal open end. The distal end 9 is formed with a drain hole 10 and a hole 11 for insertion of a snap swivel 20 (see FIG. 5) from which the knife holder 2 may be suspended.

The sheath 6 is provided on the second side wall 6B with a metallic hook member 12 by means of which the sheath 6 may be hung directly on a diver's belt. In this manner, the knife holder 2 can be put on the diver's outfit such as a belt utilizing the hook member 12 or the snap swivel 20 so that the knife 1 may be drawn out from the sheath 6 downwardly, i.e., with the distal end 9 pointing upward and the proximal open end 8 pointing downward.

Figure 3:
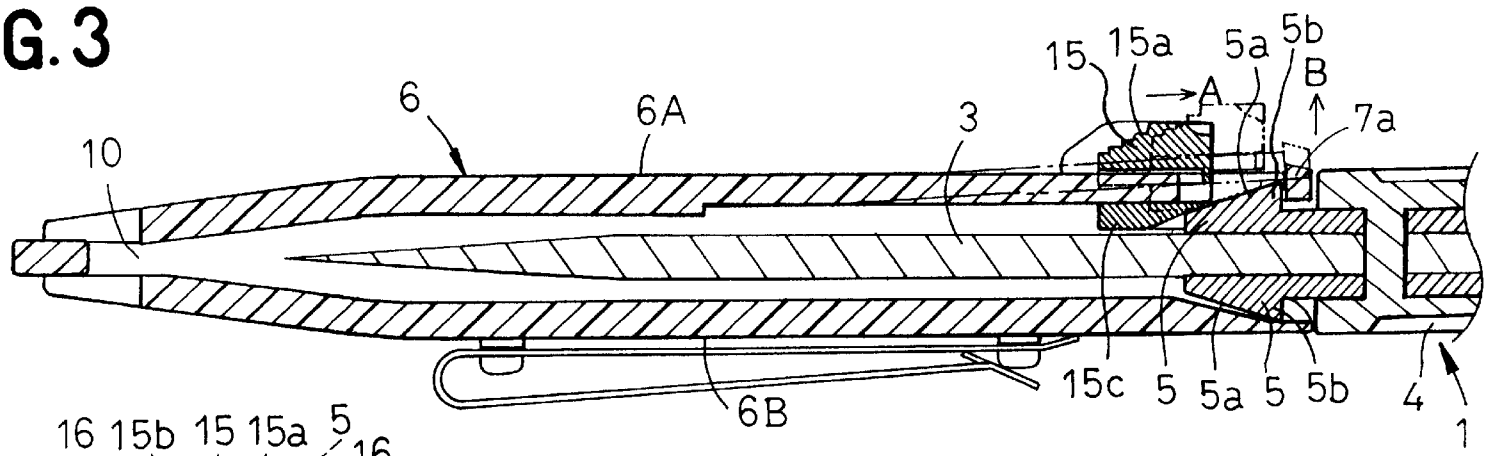
FIG. 3 is a sectional view of an important part of the portable knife along a line III—III in FIG. 1.

As shown in FIGS. 1 and 3, the locking projections 5 are provided on both surfaces, respectively, of the grip 4 at locations closely adjacent the blade 3 and have slide surfaces 5*a*, which are symmetrically sloping so that the distance between the surfaces 5*a* and 5*a* becomes larger in the direction towards the grip. The locking projections 5 extend slightly beyond a forward end of the grip 4 over the blade 3. The symmetric arrangement of the locking projections 5 on both surfaces of the grip 4 conveniently allows the diver to insert the blade 3 into the sheath 6 without discrimination between the opposite surfaces of the blade. The slide surfaces 5*a* have their maximum heights at their rearward ends 5*b* so dimensioned that these ends 5*b* do not project outward from the retainer portion 7.

The retainer portion 7 includes a part 6C of the first side wall 6A of the sheath 6 and an annular frame 13. The part 6*c* has an inner surface and an outer surface, and the annular frame 13 defines, in the vicinity of the proximal open end 8 of the sheath 6, an opening dimensioned to be engageable with either of the locking projections 5. The sheath 6 is provided with a pair of slits 14 running along both sides of the wall 6A (see FIG. 1) and extending from the proximal open end 8 towards distal end 9 opposing to the proximal open end 8 and these slits 14 define the part 6C of the wall 6A. The retainer portion 7 functions as a leaf spring which is elastically flexible so that the annular frame 13 may be engaged with and disengage from either of the locking projections 5.

Figure 4:
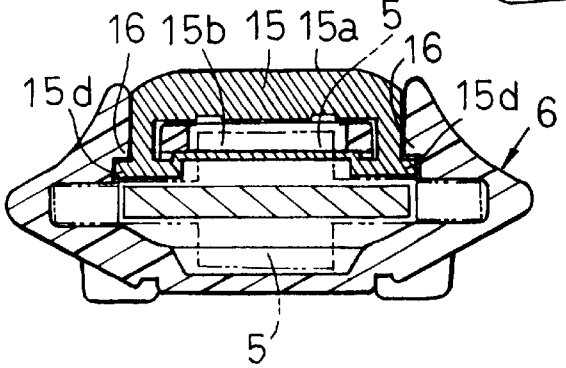
FIG. 4 is a sectional view of the important part of the portable knife along a line IV—IV in FIG. 1.

As shown in FIG. 4, an actuating slider 15 of the knife holder 2 has a hollow portion 15*b*, which is slidably engaged with the part 6C of the wall 6A. The slider 15 is movable on the part 6C in directions along which the knife 1 is inserted into and drawn from the sheath 6. The retainer portion 7 is formed with a projection 7*a* (see FIGS. 1 and 3) serving as a stopper to hold the knife 1 inserted into the knife holder 2 and the actuating slider 15 against falling off from the sheath 6.

Operation of engageably sheathing the knife 1 is performed as follows: one of the slide surfaces 5*a* of the locking projections 5 comes in slidable contact with a bottom surface of the annular frame 13 as the blade 3 is inserted into the sheath 6. Further insertion of the blade 3 causes the retainer portion 7 to be progressively lifted against its own elasticity until the annular frame 13 rides across the locking projection 5 and this projection 5 engages with the annular frame 13. Thereupon the retainer portion 7 elastically returns to its locking position. In this state, the knife 1 is held in the sheath 6 by the retainer portion 7.

In the state as shown by FIG. 3, the blade 3 is completely inserted into the sheath 6. To draw out the blade 3 from the sheath 6, the diver may put his or her finger on a top portion 15*a* of the actuating slider 15 and slidably move the actuating slider 15 in the direction A along which the blade 3 is drawn out from the sheath 6. In response to such a slidable movement of the actuating slider 15, a bottom portion 15*c* of the actuating slider 15 slides along one of the slide surfaces 5*a* of the locking projections 5. The actuating slider 15 is progressively lifted along this slide surface 5*a* and correspondingly the bottom portion 15*c* which has been adjacent the lower surface of the retainer portion 7 pushes up the retainer portion 7 away from the grip 4 in the direction B. The actuating slider 15 finally reaches the highest locking end 5*b* of the slide surface 5*a* and thereupon the annular frame 13 which has been lifted in the direction B is disengaged from the locking projection 5.

It should be understood that the bottom portion 15*c* of the actuating slider 15 is sloped upward from the bottom in conformity with the slope of the slide surface 5*a*. Such a configuration facilitates sliding of the bottom portion 15*c* of the actuating slider 15 along the sloped slide surface 5*a* of the locking projections 5.

The retainer portion 7 is normally biased under its own elasticity to return to its locking position and therefore a contact pressure between the actuating slider 15 and the slide surface 5*a* progressively increases as the retainer portion 7 is progressively lifted away from the sheath 6. Such a contact pressure forces the knife 1 to be shifted out from the sheath 6. After the knife 1 has been shifted in this manner, the retainer portion 7 restores its locking position.

Referring to FIG. 4, the bottom of the actuating slider 15 extends outward transversely of the sheath 6 so as to form a pair of flanges 15*d*. On the other hand, the sheath 6 is formed on its inner wall within a given range extending from the proximal open end 8 and along the paired slits 14 with stepwise projections 16 transversely opposed to each other. The flanges 15*d* are cooperatively engaged with the corresponding stepwise projections 16 so as to prevent the retainer portion 7 from yielding in the direction along which the retainer portion 7 might be disengaged from the locking projection 5 even if the grip 4 collides with a solid object. The actuating slider 15 has both of side portions which are connecting the top portion 15*a* and the bottom portion 15*c* and movable in the pair of the slits 14.

Figure 5:
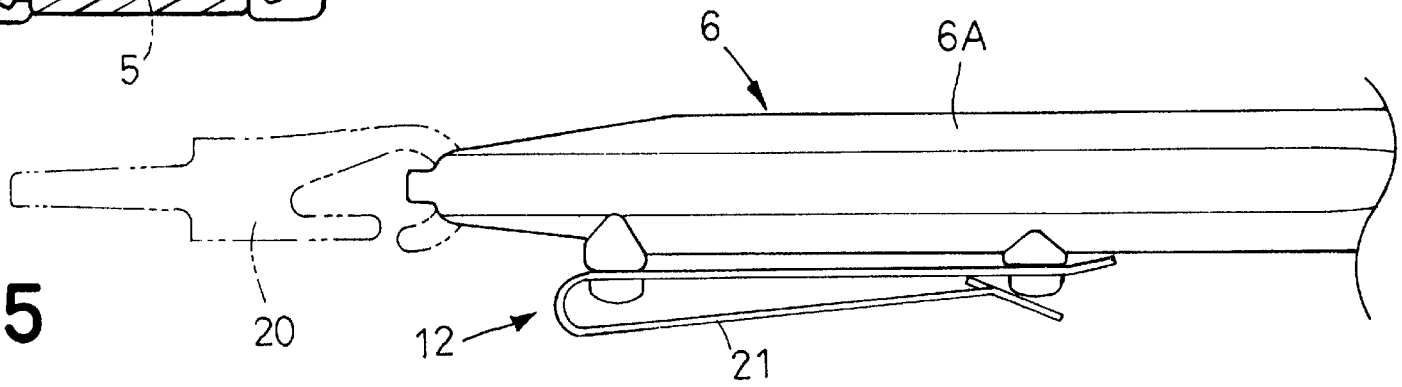
FIG. 5 is a partial side view of the portable knife shown in FIG. 1.

FIG. 5 is a partial side view of the knife holder 2 shown in FIG. 1, illustrating the hook member 12 provided on the second wall 6B (FIG. 4) of the sheath 6. The hook member 12 may be of a so-called universal type and includes a snap hook 21 adapted to be fastened on a diver's belt. The hook member 12 may be replaced by a snap swivel 20 shown by an imaginary line to put the knife holder 2 on the diver's outfit.

With the knife holder according to the invention, the actuating slider adapted to slide along the retainer portion has a sloped slide surface allowing the actuating slider to define, together with the outer surface of the sheath, a substantially continuous and smooth surface. In addition, the locking projections formed on the grip are configured not to project outward from the retainer portion. Thus the portable knife of the present invention can be configured to present a substantially smooth surface as a whole. The actuating slider can be actuated with a single finger of the diver and therefore the blade of the knife can be quickly drawn out from the sheath. The novel portable knife is advantageous also in that the blade is reliably held in the sheath even if the grip of the knife collides with or is caught by a solid object.

What is claimed is:

1. A portable knife comprising:

(a) a knife including a blade and a grip connected to the blade, wherein the grip has a locking projection at least on one side of the grip and the locking projection has a slide surface inclined outwardly and away from the blade toward the grip; and (b) a sheath formed physically separate and capable of being apart from the knife and including a first sidewall and a second sidewall connected along their peripheries to define an open end and a space therebetween for receiving the blade to be inserted, said open end including a stopper having an elastically deformable retainer portion and an actuating slider, the retainer portion being defined by a pair of slits provided in at least one said sidewall of the sheath so as to extend from the open end towards a distal end opposite to the open end, said slits being spaced from each other transversely of the sidewall to define a frame projecting from the open end, said frame supporting said stopper and being movable upon contact between the slide with the slide surface of the locking projection of the knife to disengage the stopper from the locking projection, said stopper being engageable with the locking projection when the blade is inserted into the sheath.

2. The portable knife of claim 1, wherein the actuating slider has a top portion for a user of the knife to put his or her finger on, a bottom portion which is adjacent an inner surface of the retainer portion and slidable on the inclined slide surface of the locking projection, and side portions movable in the pair of slits of the sidewall, and wherein the bottom portion pushes up the retainer portion when the bottom portion of the slider slides upward along the inclined slide surface of the locking projection.

3. A portable implement, comprising:

a grip having a tool connected thereto, said grip including a locking projection formed on a portion thereof located adjacent the tool; and a sheath formed with an open end adapted to receive the tool, said open end including a stopper having an elastically deformable retainer portion and an actuating slider slidable thereon, wherein, when said tool is inserted into the sheath to a predetermined extent, said stopper being engageable with the locking projection to secure the tool within the sheath, said slider being movable by a user to interact with the locking projection and cause the stopper to unlock from the locking projection to permit withdrawal of the tool and physical separation from the sheath.

4. The implement of claim 3, wherein said tool is a knife blade.

* * * * *